US010632703B2

(12) United States Patent
Oyama et al.

(10) Patent No.: US 10,632,703 B2
(45) Date of Patent: Apr. 28, 2020

(54) POWDERY MATERIAL MIXING AND FEEDING DEVICE AND COMPRESSION-MOLDING MACHINE INCLUDING THE SAME

(71) Applicant: KIKUSUI SEISAKUSHO LTD., Kyoto-shi (JP)

(72) Inventors: Jun Oyama, Kyoto (JP); Naoshige Kitamura, Kyoto (JP); Masaoki Murakoshi, Tokyo (JP)

(73) Assignee: KIKUSUI SEISAKUSHO LTD., Kyoto-Shi, Kyoto (JP)

( * ) Notice: Subject to any disclaimer, the term of this patent is extended or adjusted under 35 U.S.C. 154(b) by 199 days.

(21) Appl. No.: 15/097,135

(22) Filed: Apr. 12, 2016

(65) Prior Publication Data

US 2016/0361885 A1 Dec. 15, 2016

(30) Foreign Application Priority Data

Jun. 15, 2015 (JP) ..... 2015-120158

(51) Int. Cl.
*B30B 15/30* (2006.01)
*B01F 7/02* (2006.01)
(Continued)

(52) U.S. Cl.
CPC ..... *B30B 15/302* (2013.01); *A61J 3/10* (2013.01); *B01F 3/18* (2013.01); *B01F 7/001* (2013.01);
(Continued)

(58) Field of Classification Search
CPC ..... B30B 15/302; B30B 11/08; A61J 3/10; B01F 3/18; B01F 7/001; B01F 7/00133; B01F 7/00158; B01F 7/00191; B01F 7/00408; B01F 7/00641; B01F 7/02; B01F 7/04; B01F 7/082; B01F 7/086; B01F 7/18; B01F 13/1027; A61K 9/14–1694;
(Continued)

(56) References Cited

U.S. PATENT DOCUMENTS 4,498,783 A * 2/1985 Rudolph ..... B01F 15/0445 366/132
2001/0024400 A1* 9/2001 Van Der Wel ..... B01F 7/00208 366/143
(Continued)

FOREIGN PATENT DOCUMENTS

JP H09-174548 A 7/1997
JP H11-104895 A 4/1999
(Continued)

*Primary Examiner* — Matthew J Daniels
*Assistant Examiner* — Andrew L Swanson
(74) *Attorney, Agent, or Firm* — McGinn I. P. Law Group, PLLC

(57) ABSTRACT

A powdery material mixing and feeding device is configured to mix at least two types of powdery materials and to feed a compression-molding machine with the mixed powdery materials. The powdery material mixing and feeding device includes a first mixer configured to rotate about a substantially vertical shaft and to mix the powdery materials, and a reservoir configured to reserve at least a part of the powdery materials, and a second mixer configured to rotate about a substantially horizontal shaft and to mix the powdery materials.

12 Claims, 12 Drawing Sheets

(51) Int. Cl.

| | |
|---|---|
| ***A61J 3/10*** | (2006.01) |
| ***B01F 7/18*** | (2006.01) |
| ***B01F 7/00*** | (2006.01) |
| ***B01F 3/18*** | (2006.01) |
| ***B01F 7/08*** | (2006.01) |
| ***B01F 7/04*** | (2006.01) |
| ***B01F 13/10*** | (2006.01) |
| ***B30B 11/08*** | (2006.01) |

(52) U.S. Cl.
CPC ..... *B01F 7/00133* (2013.01); *B01F 7/00158* (2013.01); *B01F 7/00191* (2013.01); *B01F 7/00408* (2013.01); *B01F 7/00641* (2013.01); *B01F 7/02* (2013.01); *B01F 7/04* (2013.01); *B01F 7/082* (2013.01); *B01F 7/086* (2013.01); *B01F 7/18* (2013.01); *B01F 13/1027* (2013.01); *B30B 11/08* (2013.01); *B01F 13/1013* (2013.01); *B01F 13/1016* (2013.01); *B01F 13/1025* (2013.01)

(58) Field of Classification Search
CPC ..... B29B 7/74; B29B 7/7461; B29B 7/7466; B29B 7/7485; B29B 7/749
See application file for complete search history.

(56) References Cited

U.S. PATENT DOCUMENTS

| | | | | |
|---|---|---|---|---|
| 2002/0064555 | A1* | 5/2002 | Cullen | A61K 9/1623 424/459 |
| 2003/0042639 | A1* | 3/2003 | Christiaens | B08B 3/02 264/39 |
| 2006/0160717 | A1* | 7/2006 | Itakura | C11D 1/28 510/447 |
| 2008/0116118 | A1* | 5/2008 | Zhu | B01F 3/1221 209/142 |
| 2012/0061869 | A1* | 3/2012 | Boeckx | A61J 3/10 264/40.1 |
| 2014/0064020 | A1* | 3/2014 | Kalidindi | B01F 9/005 366/223 |

FOREIGN PATENT DOCUMENTS

| | | | |
|---|---|---|---|
| JP | 2008-183168 | A | 8/2008 |
| JP | 2014-221343 | A | 11/2014 |
| WO | WO 2010/128359 | A1 | 11/2010 |
| WO | WO 2014/207510 | A1 | 12/2014 |

* cited by examiner

POWDERY MATERIAL MIXING AND FEEDING DEVICE AND COMPRESSION-MOLDING MACHINE INCLUDING THE SAME

BACKGROUND

In the related art, a tablet of a pharmaceutical product or the like has typically been produced in accordance with a batch method including formation of an intermediate product in each of the processes of granulating, drying, mixing, and the like and production of a tablet in the final process of tableting (i.e., compression molding).

However, the batch method includes several processes of scaling-up in the course of scaling-up a small compression-molding machine for research and development to a large compression-molding machine for commercial use. Furthermore, it is necessary to conduct verification experiments for such scaling-up, and thus there is a problem of increasing the frequency of using a raw material (i.e., a powdery material) and causing enormous costs.

Furthermore, the batch method includes standby periods between the processes and thus has difficulty in timely feeding of an intermediate product. Furthermore, the batch method has a problem of requiring facility design for each of the processes and occupying a large space. Specifically, a single chamber is used for each of the processes, and a worker needs to deliver an intermediate product to a chamber for the subsequent process.

Accordingly, there is a demand for continuously conducting the processes unlike in the batch method.

JP 2008-183168 A describes a volumetric feeding device and an in-line mixer. However, the volumetric feeding device is not configured to simultaneously measure and feed a powdery material, and the in-line mixer is configured only for horizontal mixing. Furthermore, JP 2008-183168 A relates to a tablet production system configured to continuously produce pharmaceutical or health food products in the form of a tablet. However, JP 2008-183168 A describes roughly mixing a micro-additive such as a lubricant and a disintegrant with a powdery material that is a raw material, but does not describe essential mixing that determines contents of the principal agents in the tablet, such as mixing an excipient or the like with a principal agent, which occupy a most part of the tablet, and mixing of principal agents with one another.

JP 2014-221343 A describes a tablet production module, and a method of continuously producing tablets.

However, JP 2014-221343 A does not specifically describe how to mix powdery materials.

SUMMARY OF THE INVENTION

It is an exemplary feature of the present invention to enable continuous mixing and tableting, and to enable direct feed of powdery materials mixed at a high mixing degree to a compression-molding machine.

The invention exemplarily provides a powdery material mixing and feeding device configured to mix at least two types of powdery materials and to feed a compression-molding machine with the mixed powdery materials, the powdery material mixing and feeding device including a first mixer including a first mixing member configured to rotate about a substantially vertical shaft and mix powdery materials and a reservoir configured to reserve at least part of the powdery materials, and a second mixer including a second mixing member configured to rotate about a substantially horizontal shaft and mix powdery materials.

Such a configuration can achieve improvement in mixing degree of the at least two types of powdery materials such as a principal agent and an excipient, and can achieve continuous and direct feed of the mixed powdery materials to the compression-molding machine. In other words, it is possible to continuously conduct the processes from mixing the powdery materials to tableting.

Furthermore, due to such a configuration, continuous mixing and tableting of the powdery materials can be achieved even without use of the so-called batch method in which, as in the related art, a large amount of powdery materials mixed by a mixer is stored in a storage chamber and the mixed powdery materials are delivered to a tableting chamber by a worker so as to be tableted. Furthermore, there is no need to store such a large amount of mixed powdery materials in the storage chamber as in the related art, and thus reduction in working space can be achieved.

Preferably, the powdery material mixing and feeding device further exemplarily includes a plurality of measuring feeders each configured to simultaneously measure and feed a powdery material, and the measuring feeders each feed at least one of the first mixer and the second mixer with the measured powdery material. The method of feeding the powdery materials may be a method of feeding the powdery materials by their own weight, or may be a method of feeding the powdery materials forcibly, such as feed of the powdery materials by an atomizer (e.g., spray device).

According to such a configuration, the powdery materials such as a principal agent and an excipient are each simultaneously measured and fed to the mixers (e.g., the first and second mixers), and thus contents of the principal agent and the like in the powdery materials become stable. Then, the compression-molding machine can be fed with the mixed powdery materials continuously and directly. In other words, it is possible to continuously conduct the processes from mixing the powdery materials to tableting.

In a case where the powdery material to be further mixed is a principal agent, the powdery material is simultaneously measured and fed by the measuring feeder so as to be mixed. Thus, there is less variation in content of the principal agent in a compression-molded product (e.g., a tablet).

The reservoir preferably includes exemplarily a powdery material passing member including a plurality of bores. In other words, the reservoir is preferably configured to reserve part of the powdery materials. According to such an exemplary configuration, a certain amount of powdery materials remains in the reservoir and is mixed in such a state. This can achieve improvement in mixing degree of the at least two types of powdery materials. The powdery material passing member may be configured as a valve (e.g., a butterfly valve).

Furthermore, the invention exemplarily provides a powdery material mixing and feeding device configured to mix at least two types of powdery materials and to feed a compression-molding machine with the mixed powdery materials, the powdery material mixing and feeding device including a first mixer including a first mixing member configured to rotate about a substantially vertical shaft and mix powdery materials, a second mixer including a second mixing member configured to rotate about a substantially horizontal shaft and mix powdery materials, and a measuring feeder configured to simultaneously measure and feed a lubricant, and the measuring feeder feeds the second mixer with the measured lubricant.

Such an exemplary configuration does not cause the lubricant to be mixed too much with a different powdery material for a long period of time, and the lubricant has less change in physical properties.

Furthermore, the exemplary invention provides a powdery material mixing and feeding device configured to mix at least two types of powdery materials and to feed a compression-molding machine with the mixed powdery materials, the powdery material mixing and feeding device including a first mixer including a first mixing member configured to rotate about a substantially vertical shaft and mix powdery materials, and a second mixer including a plurality of second mixing members each configured to rotate about a substantially horizontal shaft and mix powdery materials.

The second mixer including the plurality of second mixing members can achieve improvement in mixing degree of the at least two types of powdery materials.

Furthermore, preferably, the powdery material mixing and feeding device further exemplary includes a measuring feeder configured to simultaneously measure and feed a lubricant, and the measuring feeder feeds the second mixer with the measured lubricant. Such a configuration does not cause the lubricant to be mixed too much for a long period of time, and the lubricant has less change in physical properties.

Furthermore, the exemplary invention provides a compression-molding machine including a table having a vertically penetrating die bore, a slidable lower punch having an upper end inserted to the die bore, and a slidable upper punch having a lower end inserted to the die bore, and including the powdery material mixing and feeding device described above.

According to such an exemplary configuration, it is possible to continuously conduct the processes from mixing the powdery materials to tableting.

Furthermore, the powdery material mixing and feeding device or the compression-molding machine preferably includes exemplary a powdery material mixing degree measurement device configured to measure a mixing degree of mixed powdery materials. The mixing degree of the mixed powdery materials can be measured in accordance with a near infrared spectroscopic analysis or the like. According to such an exemplary configuration, it is possible to check whether or not the powdery materials are mixed properly and continuously. This leads to quality maintenance of a molded product (e.g., a tablet).

Furthermore, the exemplary invention provides a method of producing mixed powdery materials with a powdery material mixing and feeding device configured to mix at least two types of powdery materials and to feed a compression-molding machine with the mixed powdery materials, the method including simultaneously measuring and feeding the powdery materials, firstly mixing the at least two types of powdery materials measured and fed in the measuring and feeding with a first mixing member configured to rotate about a substantially vertical shaft, and secondly mixing the powdery materials subjected to the first mixing with a second mixing member configured to rotate about a substantially horizontal shaft.

The powdery materials mixed in accordance with this method can be fed continuously and directly to the compression-molding machine. In other words, it is possible to continuously conduct the processes from mixing the powdery materials to tableting.

Furthermore, in the production method, the first mixing preferably includes reserving at least part of the powdery materials to be mixed. Such a configuration can achieve improvement in mixing degree of the powdery materials in the first mixing.

Furthermore, the exemplary production method preferably includes simultaneously measuring and feeding a lubricant to the powdery material mixing and feeding device. Such a configuration can achieve mixing the powdery materials including the lubricant.

Furthermore, the exemplary invention provides a method of producing a compression-molded product with a compression-molding machine from at least two types of powdery materials mixed, the method including simultaneously measuring and feeding the powdery materials, firstly mixing the at least two types of powdery materials measured and fed in the measuring and feeding with a first mixing member configured to rotate about a substantially vertical shaft, secondly mixing the powdery materials subjected to the first mixing with a second mixing member configured to rotate about a substantially horizontal shaft, filling with the mixed powdery materials a die bore of the compression-molding machine including an upper punch, a lower punch, and the die bore after the second mixing, and compression molding the mixed powdery materials with which the die bore is filled, with the upper punch and the lower punch after the filling.

With use of such a production method, it is possible to continuously conduct the processes from mixing the powdery materials to tableting.

Furthermore, the exemplary production method preferably includes measuring a mixing degree of the mixed powdery materials after the mixing of the powdery materials by the powdery material mixing and feeding device. Including this process enables the situation of the mixing to be checked promptly. This leads to quality maintenance of the mixed powdery materials and the molded product. Furthermore, no test is required between the processes, and this achieves reduction in a time period for production of the molded product. Furthermore, it is easier to specify a cause of a defect when the defect occurs.

The powdery material in the exemplary invention refers to an aggregate of minute solids and includes an aggregate of particles such as granules and an aggregate of powder smaller than the particles. Then, the powdery material also includes a lubricant such as magnesium stearate. The powdery materials subjected to the mixing by the powdery material mixing and feeding device are referred to as the mixed powdery materials for convenient description. However, the mixed powdery materials are also regarded as a type of a powdery material.

Furthermore, the type of a powdery material refers to a powdery material containing a principal agent, an excipient, a binder, a disintegrant, a lubricant, a stabilizer, a preservative, and the like, and is a concept of including the mixed powdery materials.

Furthermore, examples of the first or second mixing member include an agitating rotor. The agitating rotor is not particularly limited in terms of its shape, and may have any shape as long as it can mix at least two types of powdery materials.

According to the exemplary invention, it is possible to conduct mixing and tableting continuously, and it is possible to directly feed the compression-molding machine with the powdery materials mixed at a high mixing degree.

DESCRIPTION OF THE EXEMPLARY EMBODIMENTS

Described below are exemplary embodiments of the present invention with reference to the drawings. A compression-molding machine according to these exemplary embodiments is of a rotary-type.

Figure 1:
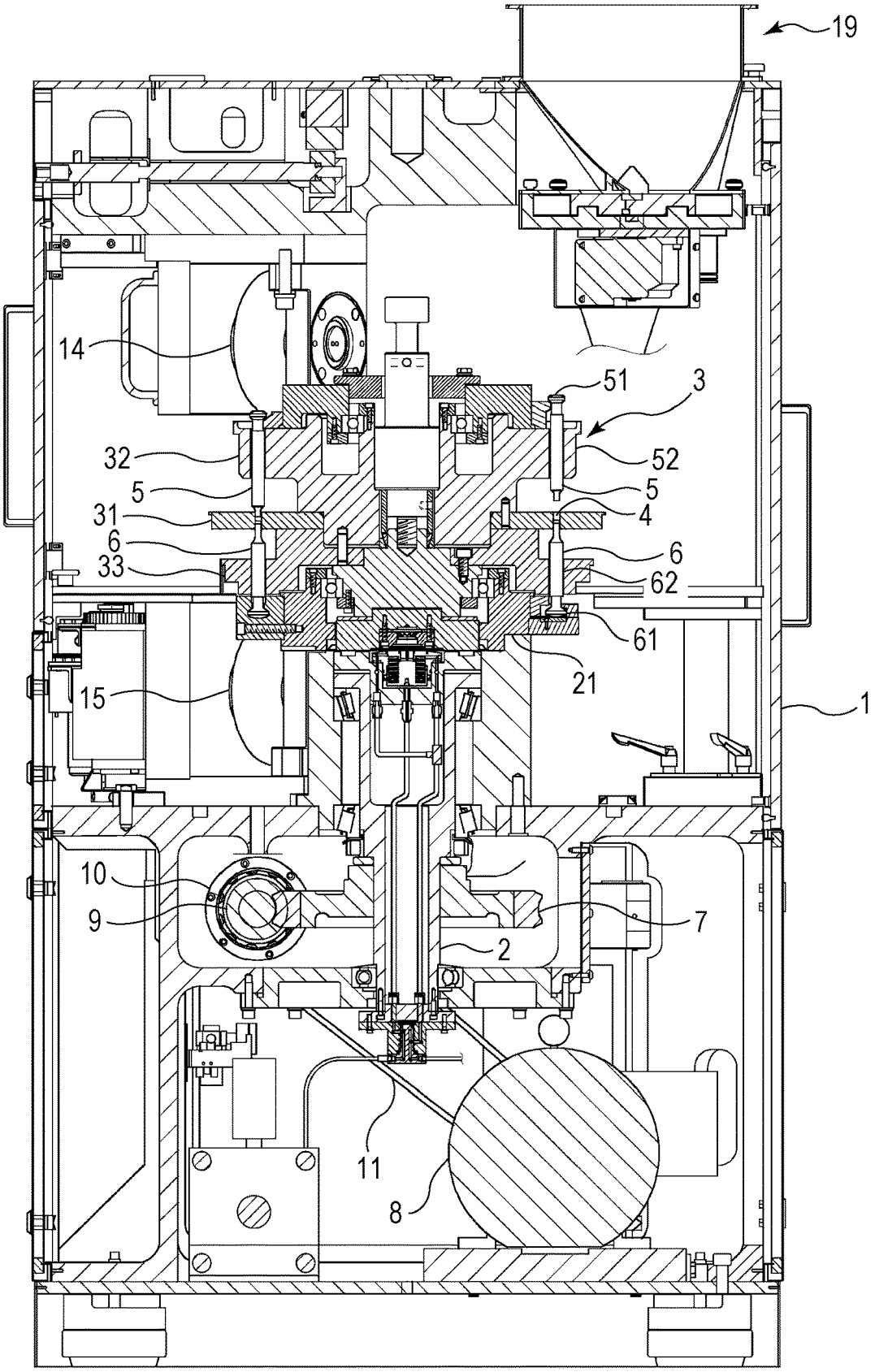
FIG. 1 is a side sectional view of a compression-molding machine according to an exemplary embodiment of the invention.

The details are as follows. Initially, an entire outline of a rotary compression-molding machine (hereinafter, referred to as the "molding machine") will be described. As shown in FIG. 1, the molding machine has a frame 1 including an upright shaft 2 functioning as a rotary shaft, and a turret 3 is attached to a connection portion 21 that is disposed at the top of the upright shaft 2.

The upright shaft 2 has the lower end to which a worm wheel 7 is attached. The worm wheel 7 meshes with a worm gear 10. The worm gear 10 is fixed to a gear shaft 9 that is driven by a motor 8. Drive power output from the motor 8 is transmitted to the gear shaft 9 by a belt 11, so as to drive to rotate the upright shaft 2 by the worm gear 10 and the worm wheel 7, and further to rotate the turret 3 as well as punches 5 and 6.

The turret 3 horizontally rotates about the upright shaft 2, more specifically, spins. The turret 3 includes a table (e.g., a die disc) 31, an upper punch retaining portion 32, and a lower punch retaining portion 33. The table 31 has a substantially circular disc shape, and a plurality of die bores 4 is formed in an outer peripheral portion thereof so as to be aligned in a direction of rotation and be spaced apart from each other at predetermined intervals. The die bores 4 each penetrate the table 31 in the vertical direction. The table 31 may include a plurality of divided plates. Instead of the die bores 4 formed directly in the table 31, a die member including the die bores 4 may be detachably attached to the table 31.

The upper punch 5 and the lower punch 6 are retained above and below a corresponding one of the die bores 4, by the upper punch retaining portion 32 and the lower punch retaining portion 33, so as to be individually slidable in the die bore 4 in the vertical direction. Each upper punch 5 has a tip 53 that enters and exits the corresponding die bore 4. Each lower punch 6 has a tip 63 that is always inserted in the corresponding die bore 4. The upper punch 5 and the lower punch 6 horizontally rotate about the upright shaft 2 together with the turret 3, more specifically, revolve.

There is included a feeder X configured to fill the die bores 4 in the turret 3 with a powdery material. Typical examples of the feeder X include an agitated feeder and a gravity feeder. The feeder X may be any of these feeders. The powdery material is fed to the feeder X by a powdery material feeding device. Then, the powdery material is fed to the powdery material feeding device by a hopper 19.

Figure 2:
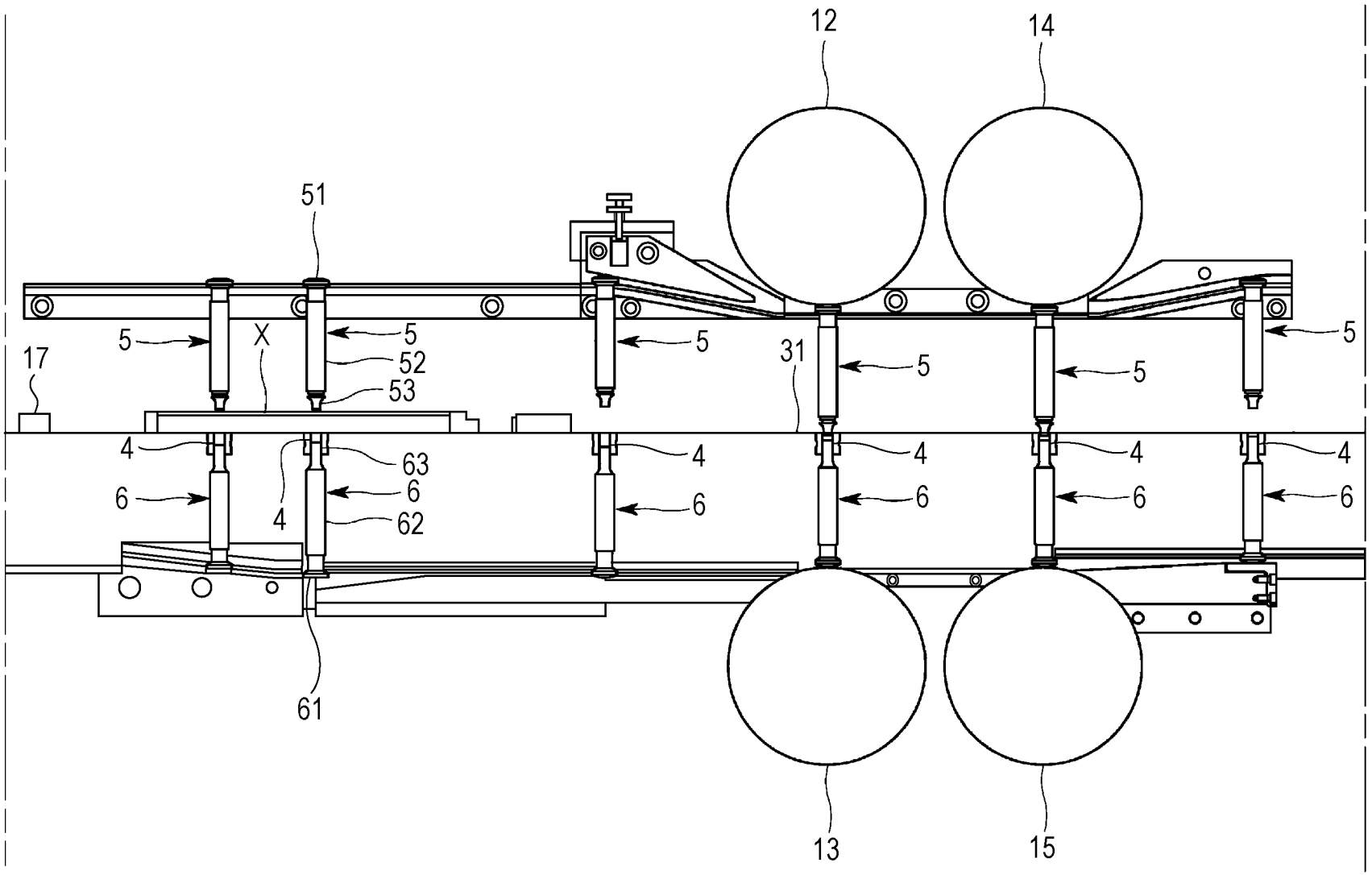
FIG. 2 is a core developed view of the compression-molding machine.

As shown exemplarily in FIG. 2, a preliminary compression upper roll 12, a preliminary compression lower roll 13, a substantial compression upper roll 14, and a substantial compression lower roll 15 are disposed on orbits of the punches 5 and 6 that revolve about the upright shaft 2. The preliminary compression upper roll 12 and the preliminary compression lower roll 13, as well as the substantial compression upper roll 14 and the substantial compression lower roll 15, are respectively paired in the vertical direction so as to sandwich the punches 5 and 6. The preliminary compression upper roll 12 and the substantial compression upper roll 14 each press a head 51 of the upper punch 5, and the preliminary compression lower roll 13 and the substantial compression lower roll 15 each press a head 61 of the lower punch 6. The preliminary compression upper roll 12 and the preliminary compression lower roll 13, as well as the substantial compression upper roll 14 and the substantial compression lower roll 15, respectively bias the upper and lower punches 5 and 6 to bring the upper and lower punches 5 and 6 close to each other, such that distal end surfaces of the tips 53 and 63 compress from above and below a powdery material with which each of the die bores 4 is filled.

A molded product unloading portion is disposed ahead, in the direction of rotation of the turret 3 and the punches 5 and 6, of the position where the substantial compression upper roll 14 and the substantial compression lower roll 15 apply pressure. The molded product unloading portion includes a guide member 17 configured to guide a molded product pushed out of the die bore 4.

Next, processes of producing the molded product will be described schematically. As shown exemplarily in FIG. 2, the lower punch 6 descends and the feeder X fills with a powdery material (e.g., mixed powdery materials) the die bore 4 into which the tip 63 of the lower punch 6 is inserted (e.g., filling). Then, the lower punch 6 ascends such that the die bore 4 is filled with a required amount of the powdery material (e.g., mixed powdery materials), and the powdery material overflowing the die bore 4 is leveled. The upper punch 5 then descends, and the preliminary compression upper roll 12 and the preliminary compression lower roll 13 press the head 51 of the upper punch 5 and the head 61 of the lower punch 6 as preliminarily compressing. The substantial compression upper roll 14 and the substantial compression lower roll 15 press the head 51 of the upper punch 5 and the head 61 of the lower punch 6 as substantially compressing (e.g., compression molding). Then, the lower punch 6 ascends until the upper end surface of the tip 63 of the lower punch 6 reaches substantially the same height as the upper end of the die bore 4, that is, the upper surface of the table 31, and pushes a molded product that is in the die bore 4, out of the die bore 4 onto a die table. The molded product pushed out of the die bore 4 is brought into contact with the guide member 17 by rotation of the turret 3, and moves along the guide member 17 toward a molded product collecting position.

Next, a powdery material mixing and feeding device Z configured to feed the hopper 19 with a powdery material will be described. As shown exemplarily in FIGS. 3 and 4, the powdery material mixing and feeding device Z according to these exemplary embodiments includes three measuring feeders Z1 (e.g., Z1*a*, Z1*b*, and Z1*c*). The number of the measuring feeders Z1 changes depending on the number of types of powdery materials to be mixed. Thus, a plurality of measuring feeders Z1 may be included and there is no particular limitation in terms of the number of the measuring feeders Z1.

Furthermore, the powdery material mixing and feeding device Z according to these exemplary embodiments includes two vertical mixers (e.g., first mixers) Z3 (e.g., Z3*a* and Z3*b*). However, there is no particular limitation in terms of the number of the vertical mixers. The first measuring feeder Z1*a*, the second measuring feeder Z1*b*, and the third measuring feeder Z1*c* are configured to measure and feed different types of powdery materials, respectively. However, these measuring feeders may measure and feed the same type of a powdery material. In these exemplary embodiments, the first measuring feeder Z1*a*, the second measuring feeder Z1*b*, and the third measuring feeder Z1*c* measure and feed a principal agent, an excipient powdery material such as lactose, and a lubricant, respectively.

First Exemplary Embodiment

Figure 3:
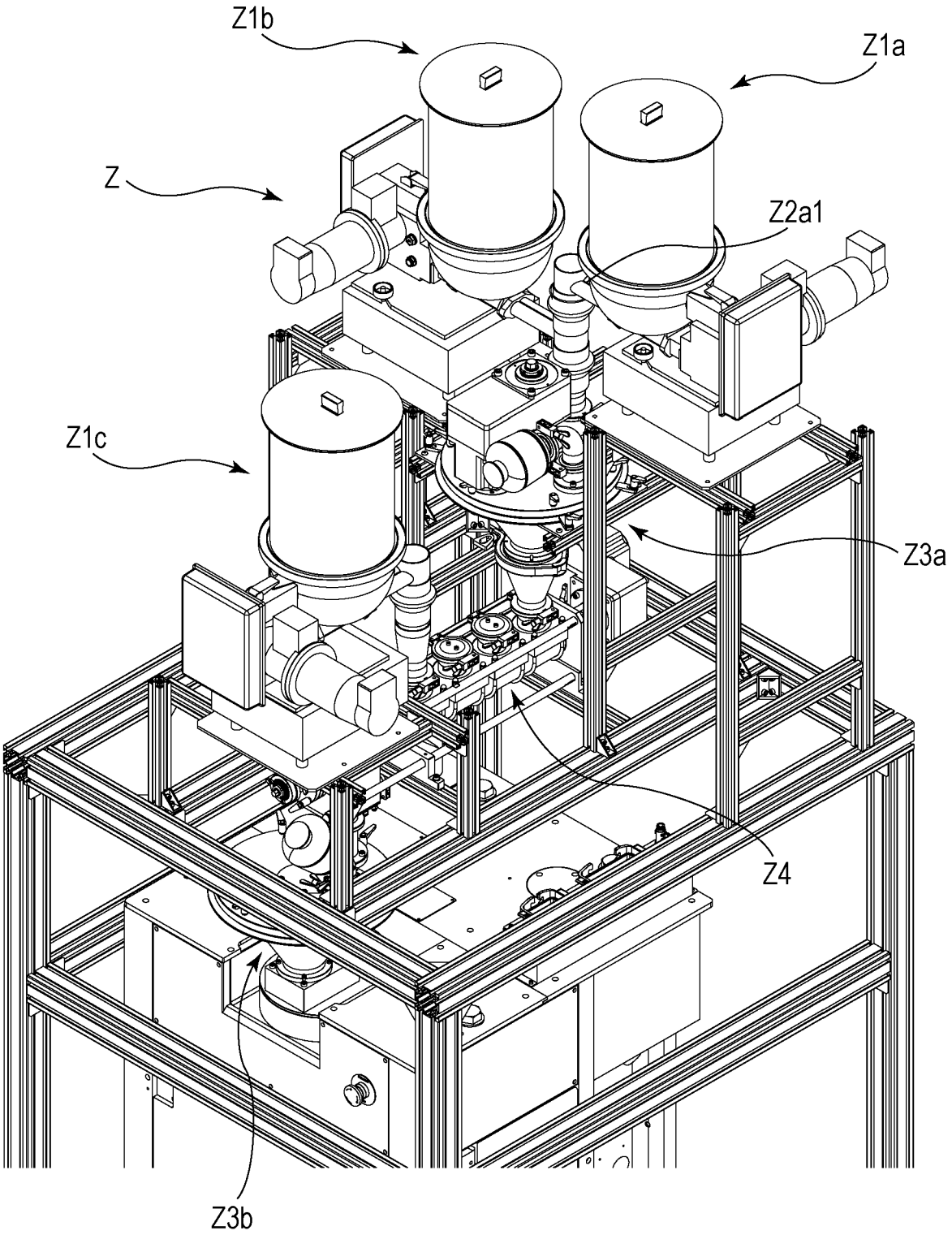
FIG. 3 is a perspective view of a compression-molding machine according to an exemplary embodiment of the invention.
Figure 4:
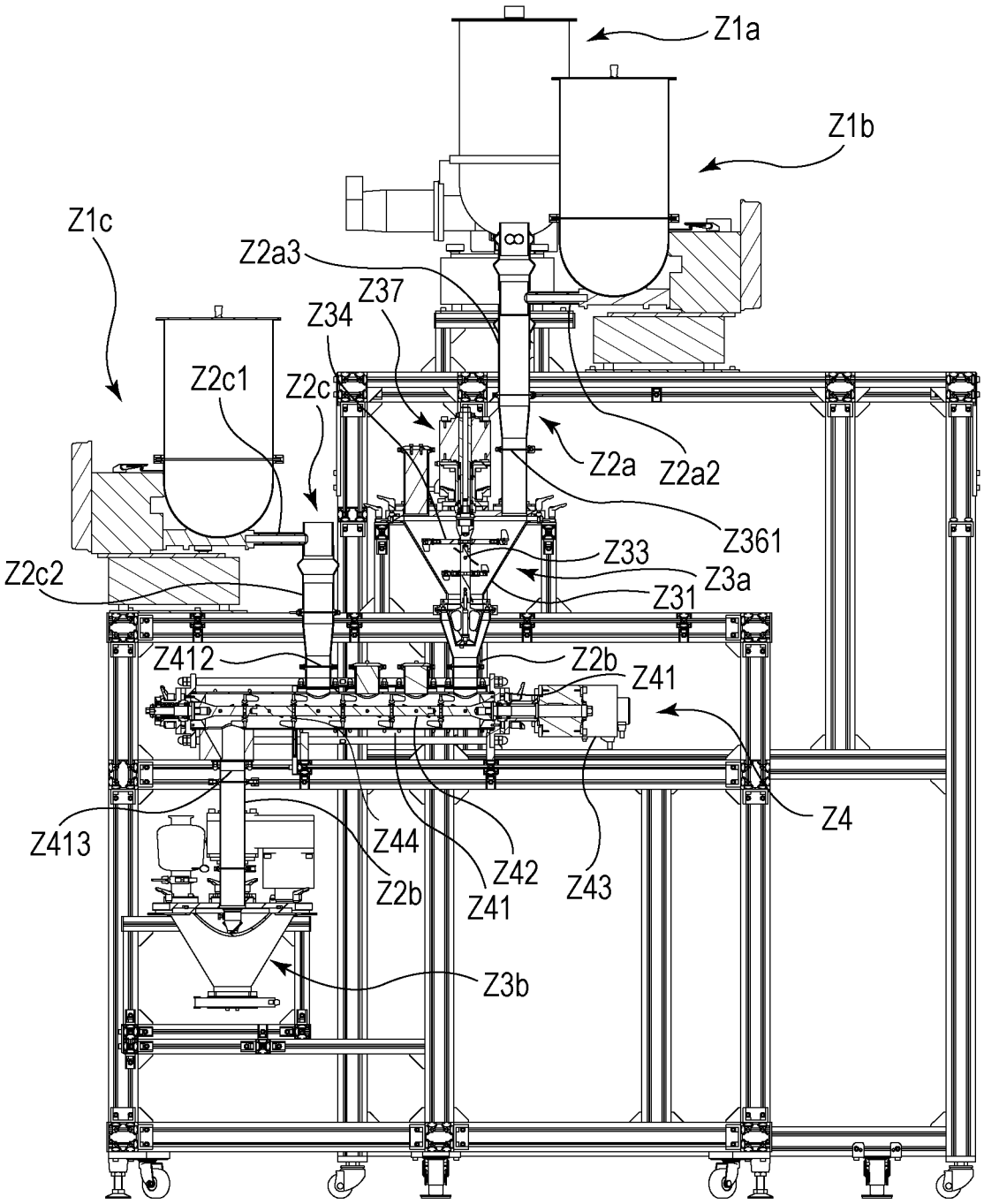
FIG. 4 is a side view of a compression-molding machine according to an exemplary embodiment of the invention.

As shown exemplarily in FIGS. 3 and 4, the powdery material mixing and feeding device Z includes the first measuring feeder Z1*a*, the second measuring feeder Z1*b*, the first vertical mixer Z3*a*, a first connecting pipe Z2*a* connecting the measuring feeders Z1 (e.g., Z1*a* and Z1*b*) and the first vertical mixer Z3*a*, a horizontal mixer Z4 (e.g., second mixer), a second connecting pipe Z2*b* connecting the first vertical mixer Z3*a* and the horizontal mixer Z4, a third connecting pipe Z2*c* connecting the third measuring feeder Z1*c* and the horizontal mixer Z4, and a fourth connecting pipe Z2*d* connecting the horizontal mixer Z4 and the second vertical mixer Z3*b*.

The exemplary FIG. 3 shows a molding machine having the powdery material mixing and feeding device Z attached thereto. The exemplary FIG. 4 is a side view of the powdery material mixing and feeding device Z, and does not show a connecting pipe connecting the second vertical mixer Z3*b* and the molding machine. Furthermore, the second vertical mixer Z3*b* and the first vertical mixer Z3*a* in FIG. 4 are similar to each other in structure, and thus FIG. 4 does not show the internal structure of the second vertical mixer Z3*b*. The measuring feeders (e.g., Z1*a*, Z1*b*, and Z1*c*) can be modified in terms of their disposition, shapes, and the like, and are not limited to those shown in FIGS. 3 and 4.

Each of the first measuring feeder Z1*a* and the second measuring feeder Z1*b* simultaneously measures and feeds a powdery material to the first connecting pipe Z2*a*, and the third measuring feeder Z1*c* simultaneously measures and feeds a powdery material to the third connecting pipe Z2*c* (e.g., measuring and feeding). The powdery material to be fed is simultaneously measured and fed to the third connecting pipe Z2*c*, and thus contents of the principal agent and the like become stable.

Connecting pipes Z2 include the first connecting pipe Z2*a*, the second connecting pipe Z2*b*, the third connecting pipe Z2*c*, and the fourth connecting pipe Z2*d*. The connecting pipes Z2 are configured to pass a powdery material from an end to an end.

The first connecting pipe Z2*a* connects the first measuring feeder Z1*a* and the second measuring feeder Z1*b* to the first vertical mixer Z3*a*. Through the first connecting pipe Z2*a*, the powdery materials discharged from the first measuring feeder Z1*a* and the second measuring feeder Z1*b* are fed to the first vertical mixer Z3*a*.

The second connecting pipe Z2*b* connects the first vertical mixer Z3*a* and the horizontal mixer Z4. Through the second connecting pipe Z2*b*, the powdery material discharged from the first vertical mixer Z3*a* is fed to the horizontal mixer Z4.

The third connecting pipe Z2*c* connects the third measuring feeder Z1*c* and the horizontal mixer Z4. Through the third connecting pipe Z2*c*, the powdery material discharged from the third measuring feeder Z1*c* is fed to the horizontal mixer Z4.

The fourth connecting pipe Z2*d* connects the horizontal mixer Z4 and the second vertical mixer Z3*b*. Through the fourth connecting pipe Z2*d*, the powdery material discharged from the horizontal mixer Z4 is fed to the second vertical mixer Z3*b*.

The first connecting pipe Z2*a* includes a first branch pipe Z2*a*1 connected with the first measuring feeder Z1*a*, a second branch pipe Z2*a*2 connected with the second measuring feeder Z1*b*, and a main pipe Z2*a*3 connected with each of the first branch pipe Z2*a*1 and the second branch pipe Z2*a*2.

The main pipe Z2*a*3 has the lower portion connected with the first vertical mixer Z3*a*. Thus, the powdery materials measured and fed by the first measuring feeder Z1*a* and the second measuring feeder Z1*b* are mixed by the first vertical mixer Z3*a* (e.g., first mixing). In this exemplary embodiment, the first measuring feeder Z1*a* and the second measuring feeder Z1*b* feed the principal agent and the excipient or the like, respectively, to the first vertical mixer Z3*a*.

The second connecting pipe Z2*b*, the third connecting pipe Z2*c*, and the fourth connecting pipe Z2*d* will be described later.

The vertical mixers Z3 functioning as the first mixers include the first vertical mixer Z3*a* and the second vertical mixer Z3*b* in this exemplary embodiment. The second vertical mixer Z3*b* will be described later. The first vertical mixer Z3*a* and the second vertical mixer Z3*b* are similar to each other in structure and will thus be described together in terms of their structure.

As shown exemplarily in FIGS. 4, 5, 6, and 7, the vertical mixer Z3 includes a lid Z36 including a feed port Z361 from which a powdery material is fed, a first case Z31 disposed below the lid Z36 and having a funnel shape, an agitation shaft Z33 disposed substantially in the center of the first case Z31 and configured to spin, an agitating rotor Z34 (e.g., first mixing member) attached to the agitation shaft Z33, a motor Z37 configured to rotate (i.e., spin) the agitation shaft Z33, a powdery material passing member Z32 disposed below the first case Z31 and including a plurality of bores Z321, an auxiliary rotor Z35 (e.g., first mixing member) configured to facilitate a powdery material to pass through the bores Z321 in the powdery material passing member Z32, and a second case Z38 covering the powdery material passing member Z32. Here, both the agitating rotor Z34 and the auxiliary rotor Z35 function as the first mixing members. There is the configuration including both the agitating rotor Z34 and the auxiliary rotor Z35 in this exemplary embodiment. However, there may be a configuration of including only one of the agitating rotor Z34 and the auxiliary rotor Z35.

The agitation shaft Z33 of the vertical mixer Z3 is not necessarily disposed vertically, but may be slanted. The vertical mixer Z3 only needs to be configured to agitate and mix powdery materials while the powdery materials fed from the feed port Z361 flow downward.

The powdery materials fed to the feed port Z361 of the vertical mixer Z3 are mixed by rotation of the agitating rotor Z34 (e.g., first mixing). Furthermore, the powdery materials may be mixed by rotation of the auxiliary rotor Z35.

The lid Z36 includes the feed port Z361 and a shaft port Z362 through which the agitation shaft Z33 passes, and is shaped to cover an upper opening of the first case Z31. The lid Z36 is attached to the first case Z31 so as to prevent a powdery material from spilling or scattering from the first case Z31.

The feed port Z361 of the lid Z36 is connected with the first connecting pipe Z2*a*. The powdery materials fed from the feed port Z361 into the first case Z31 are agitated and mixed by rotation of the agitating rotor Z34. The powdery material passing member Z32 disposed at a reservoir has the plurality of bores Z321 through which the mixed powdery materials pass.

The amount of the powdery material fed from the feed port Z361 or rotational speed of the auxiliary rotor Z35 can be adjusted such that the amount of the powdery material fed from the feed port Z361 becomes larger than the amount of the powdery material passing through the bores Z321. A certain amount of the powdery material thus remains in the reservoir.

In other words, at least part of the powdery materials measured and fed by the first measuring feeder Z1*a* and the second measuring feeder Z1*b* remains in the reservoir in the first vertical mixer Z3*a* (e.g., reserving) and is agitated by the auxiliary rotor Z35 so as to achieve improvement in mixing degree of the powdery materials. There may be included a plurality of feed ports Z361.

The first case Z31 has an open top and a lower portion including the powdery material passing member Z32. The first case Z31 according to this exemplary embodiment has a substantially funnel shape. However, the first case Z31 is not limited to this shape but may have any shape as long as it is configured to enable feed of a powdery material to the powdery material passing member Z32.

The center in a planar view of the first case Z31 includes the agitation shaft Z33, and the agitation shaft Z33 is rotated (e.g., spun) by the driven motor Z37. The agitating rotor Z34 is attached to each of the top and the center in the axial direction of the agitation shaft Z33, and the auxiliary rotor Z35 is attached to the lower end in the axial direction of the agitation shaft Z33. Rotation of the agitation shaft Z33 rotates the agitating rotors Z34 and the auxiliary rotor Z35.

The agitating rotors Z34 (e.g., first mixing members) agitate and mix the powdery materials fed from the feed port Z361 into the first case Z31. The agitating rotors Z34 may have any shape. The agitating rotors Z34 shown exemplarily in FIGS. 4 and 5 have a rectangular distal end and are disposed at two positions on the agitation shaft Z33. On the other hand, the vertical mixer Z3 shown in FIG. 7 is different in structure from the vertical mixer Z3 shown exemplarily in FIGS. 4 and 5.

Figure 5:
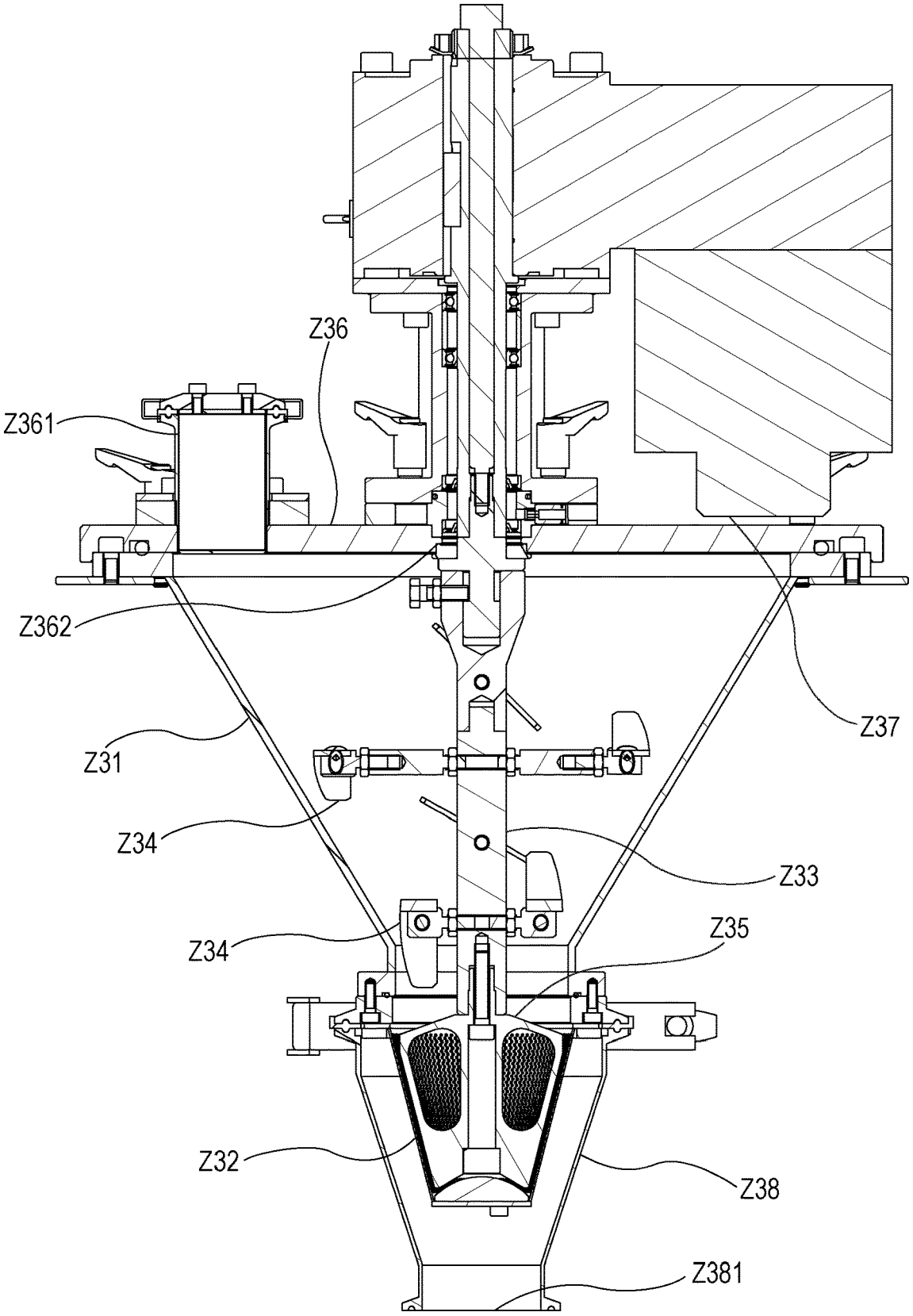
FIG. 5 is a side sectional view of a vertical mixer included in a powdery material mixing and feeding device according to an exemplary embodiment of the invention.
Figure 7:
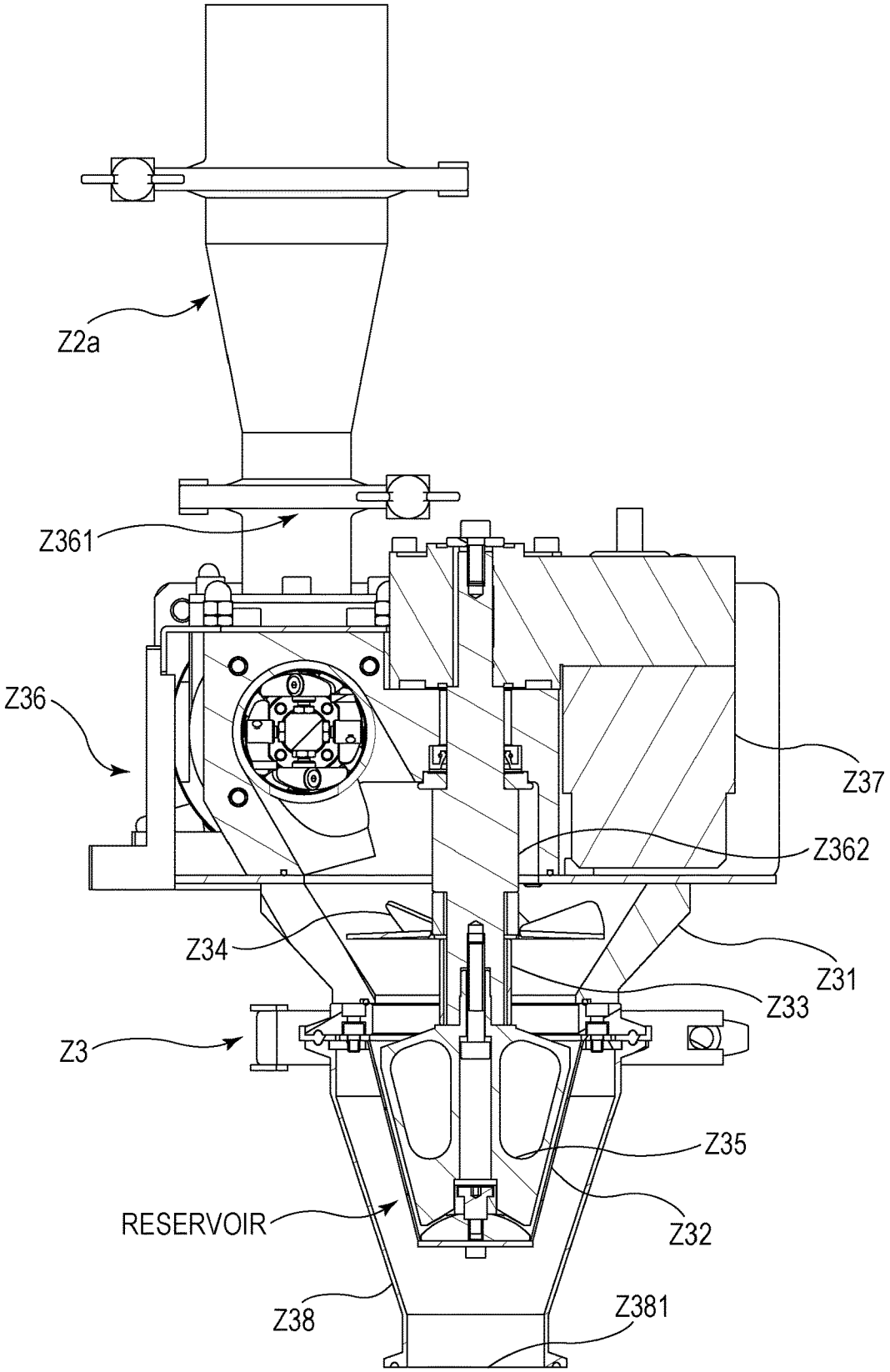
FIG. 7 is a side sectional view of a vertical mixer included in a powdery material mixing and feeding device according to an exemplary embodiment of the invention.

In other words, the vertical mixer Z3 shown in FIG. 7 includes the agitating rotor Z34 that is disposed at a single position on the agitation shaft Z33 and is shaped differently from the agitating rotor Z34 shown in FIGS. 4 and 5. Note that the agitating rotor Z34 is not limited in terms of its shape or position to those shown in FIGS. 4, 5, and 7.

Figure 6:
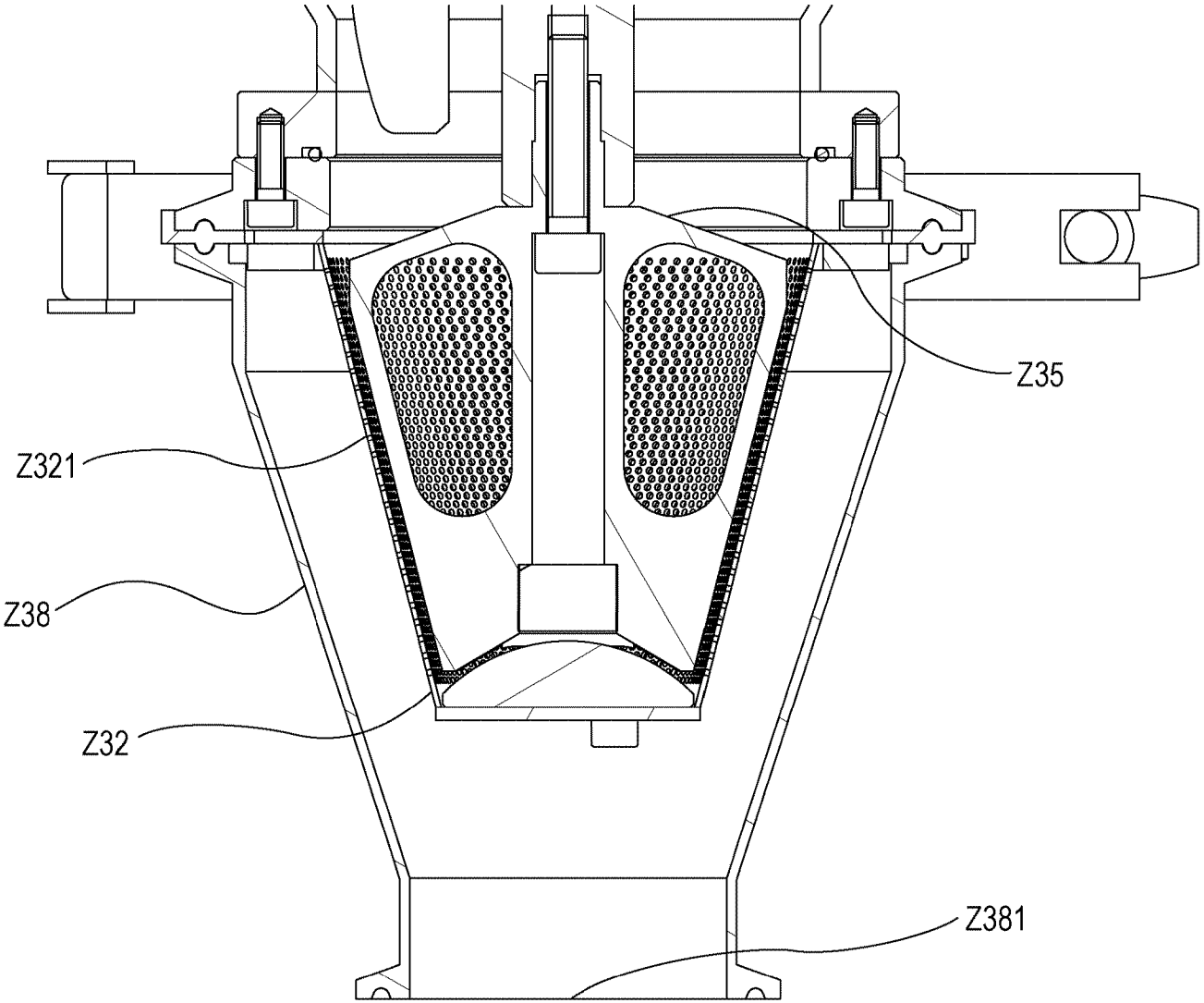
FIG. 6 is a partially enlarged view of a side sectional view of the vertical mixer according to the exemplary embodiment.

As shown exemplarily in FIG. 6, the lower portion of the first case Z31 includes the powdery material passing member Z32 of the reservoir, and the powdery material passing member Z32 includes the plurality of bores Z321. The powdery material passing member Z32 is covered with the second case Z38. A powdery material passing through the bores Z321 in the powdery material passing member Z32 is discharged from a discharge port Z381 that the lower portion of the second case Z38 includes. The number and the diameter size of the bores Z321 may be any number and diameter size.

According to such an exemplary configuration, powdery materials remain in the powdery material passing member Z32 and improvement in mixing degree of powdery materials is achieved. In the first vertical mixer Z3*a*, a powdery material passing through the bores Z321 in the powdery material passing member Z32 is fed to the horizontal mixer Z4 by way of the second connecting pipe Z2*b*.

The auxiliary rotor Z35 agitates a powdery material in the reservoir. The center in a planar view of the reservoir and the lower portion of the agitation shaft Z33 include the auxiliary rotor Z35. The auxiliary rotor Z35 according to this exemplary embodiment is shaped to be adapted to the inner shape of the powdery material passing member Z32 and facilitate a powdery material to pass through the bores Z321. The auxiliary rotor Z35 is also of a type of an agitating rotor.

Furthermore, the vertical mixer Z3 according to this exemplary embodiment includes the agitating rotors Z34. The vertical mixer Z3 may be configured to include the second case Z38, the powdery material passing member Z32, and the auxiliary rotor Z35.

The second case Z38 covers the powdery material passing member Z32, has a substantially funnel shape, and includes the discharge port Z381 at the lower portion. The second case Z38 guides a powdery material passing through the bores Z321 in the powdery material passing member Z32 to the discharge port Z381.

The second connecting pipe Z2*b* connects the first vertical mixer Z3*a* and the horizontal mixer Z4 to be described later. The second connecting pipe Z2*b* is connected to the lower portion of the first vertical mixer Z3*a* and feeds the horizontal mixer Z4 with a powdery material passing through the discharge port Z381 of the first vertical mixer Z3*a*. The second connecting pipe Z2*b* is connected with the top of the horizontal mixer Z4.

As shown exemplarily in FIG. 4, the horizontal mixer Z4 functioning as the second mixer includes a cylindrical case Z41, an agitation shaft Z42 disposed substantially in the center of the case Z41 and configured to spin, a motor Z43 configured to rotate (e.g., spin) the agitation shaft Z42, and an agitating rotor Z44 attached to the agitation shaft Z42 and configured to rotate so as to move a powdery material substantially horizontally. The case Z41 according to this exemplary embodiment does not rotate (e.g., spin), but the case Z41 may be configured to rotate. This achieves further improvement in mixing degree of the powdery materials. The horizontal mixer Z4 mixes the fed powdery materials (e.g., second mixing).

The case Z41 has a top including a plurality of feed ports from which a powdery material is fed into the case Z41, and a discharge port Z413 through which mixed powdery materials are discharged from the case Z41. In this exemplary embodiment, the case Z41 has two feed ports (e.g., a first feed port Z411 and a second feed port Z412), and the second connecting pipe Z2*b* is connected to the first feed port Z411 of the case Z41 of the horizontal mixer Z4.

From the first feed port Z411, a powdery material is fed into the case Z41. The agitating rotor Z44 rotates to move the powdery material fed into the case Z41 to the discharge port Z413 of the case Z41.

From the second feed port Z412, a lubricant is fed through the third connecting pipe Z2*c*. The agitation shaft Z42 and the agitating rotor Z44 rotate to move the lubricant fed into the case Z41 to the discharge port Z413 of the case Z41. Any of the feed ports not in use preferably is covered with a lid.

The discharge port Z413 is disposed at the lower portion of the case Z41. The discharge port Z413 is connected with the fourth connecting pipe Z2*d* to be described later. Then, the agitating rotor Z44 rotates to discharge the mixed powdery materials in the case Z41 from the discharge port Z413 and move the mixed powdery materials to the fourth connecting pipe Z2*d*.

Figure 11:
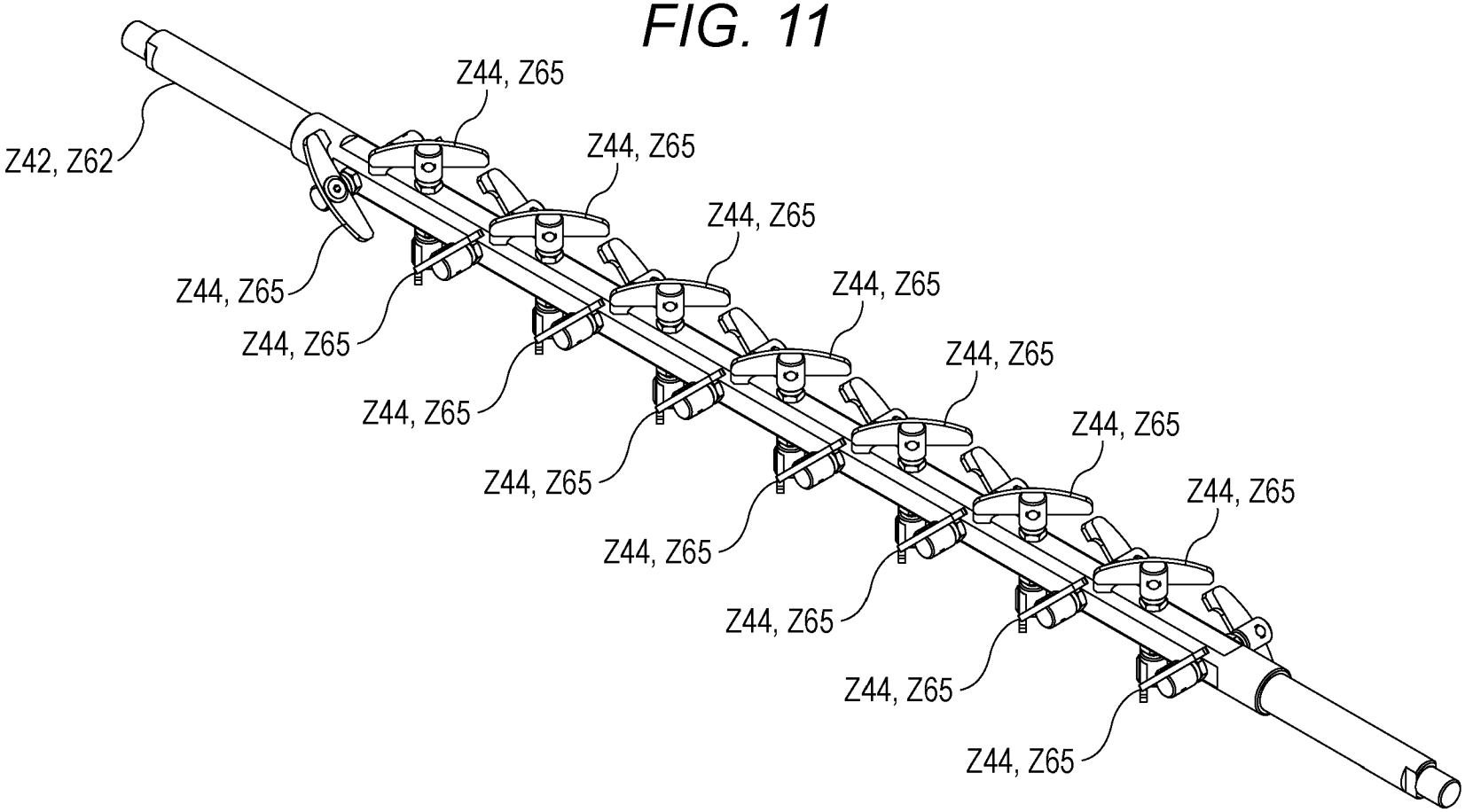
FIG. 11 is a perspective view of an agitation shaft and an agitating rotor (e.g., a second mixing member) of a horizontal mixer included in a powdery material mixing and feeding device according to an exemplary embodiment of the invention.

The agitation shaft Z42 extends in a longitudinal direction of the case Z41 and is disposed substantially in the center in a sectional view. The agitation shaft Z42 is rotated (e.g., spun) by the driven motor Z43. As shown in FIG. 11, the agitating rotor Z44 is attached to the agitation shaft Z42. Rotation of the agitation shaft Z42 rotates the agitating rotor Z44 to simultaneously mix and move the powdery materials toward the discharge port Z413.

The agitating rotor Z44 is configured to agitate and mix the powdery materials fed from the feed ports (e.g., Z411 and Z412) into the case Z41. The agitating rotor Z44 may have any shape, but is preferably configured to simultaneously mix and move the powdery materials toward the discharge port Z413. As shown in FIG. 11, the agitating rotor Z44 according to this exemplary embodiment has a shape obtained by expanding both ends of the agitating rotor Z34, and an angle of the agitating rotor Z44 to the agitation shaft Z42 can be adjusted freely.

The third measuring feeder Z1*c* is configured to measure and feed a lubricant to the horizontal mixer Z4. The third connecting pipe Z2*c* is connected to the lower portion of the third measuring feeder Z1*c*. The lubricant in the third measuring feeder Z1*c* is fed to the horizontal mixer Z4 through the third connecting pipe (e.g., lubricant feeding). The lubricant may be fed to the horizontal mixer Z4 by a μR feeder (manufactured by Nisshin Engineering Inc.). Furthermore, the lubricant may be fed to the horizontal mixer Z4 by an atomizer (e.g., spray device).

The third connecting pipe Z2*c* includes a branch pipe Z2*c*1 and a main pipe Z2*c*2. The branch pipe Z2*c*1 is connected to the lower portion of the third measuring feeder Z1*c*, and has an other end connected to the main pipe Z2*c*2. The lower portion of the main pipe Z2*c*2 is connected to the second feed port Z412 of the horizontal mixer Z4.

The fourth connecting pipe Z2*d* has the upper end connected with the discharge port Z413 of the horizontal mixer Z4 and the lower end connected with the feed port Z361 of the second vertical mixer Z3*b*. The powdery materials mixed by the horizontal mixer Z4 are fed from the discharge port Z413 through the fourth connecting pipe Z2*d* to the second vertical mixer Z3*b*.

The second vertical mixer Z3*b* has the structure as described above. The lower portion of the second vertical mixer Z3*b* is connected to the compression-molding machine. The mixed powdery materials passing through the bores Z321 in the powdery material passing member Z32 disposed at the lower portion of the second vertical mixer Z3*b* are fed into the compression-molding machine for compression molding.

The mixing degree of the mixed powdery materials discharged from the powdery material mixing and feeding device Z is measured by the powdery material mixing degree measurement device before the powdery materials are fed into the feeder X functioning as a filling device in the compression-molding machine. Setting is made such that an alert is issued or the device stops when the mixing degree is out of a predetermined range.

Second Exemplary Embodiment

Description will be made to an exemplary embodiment different from the first exemplary embodiment of the invention. The features similar to those of the first exemplary embodiment will not be described repeatedly.

A horizontal mixer (e.g., second mixer) shown in FIGS. 8 and 9 will be described by focusing on differences in configuration from the horizontal mixer Z4 according to the first exemplary embodiment.

Figure 8:
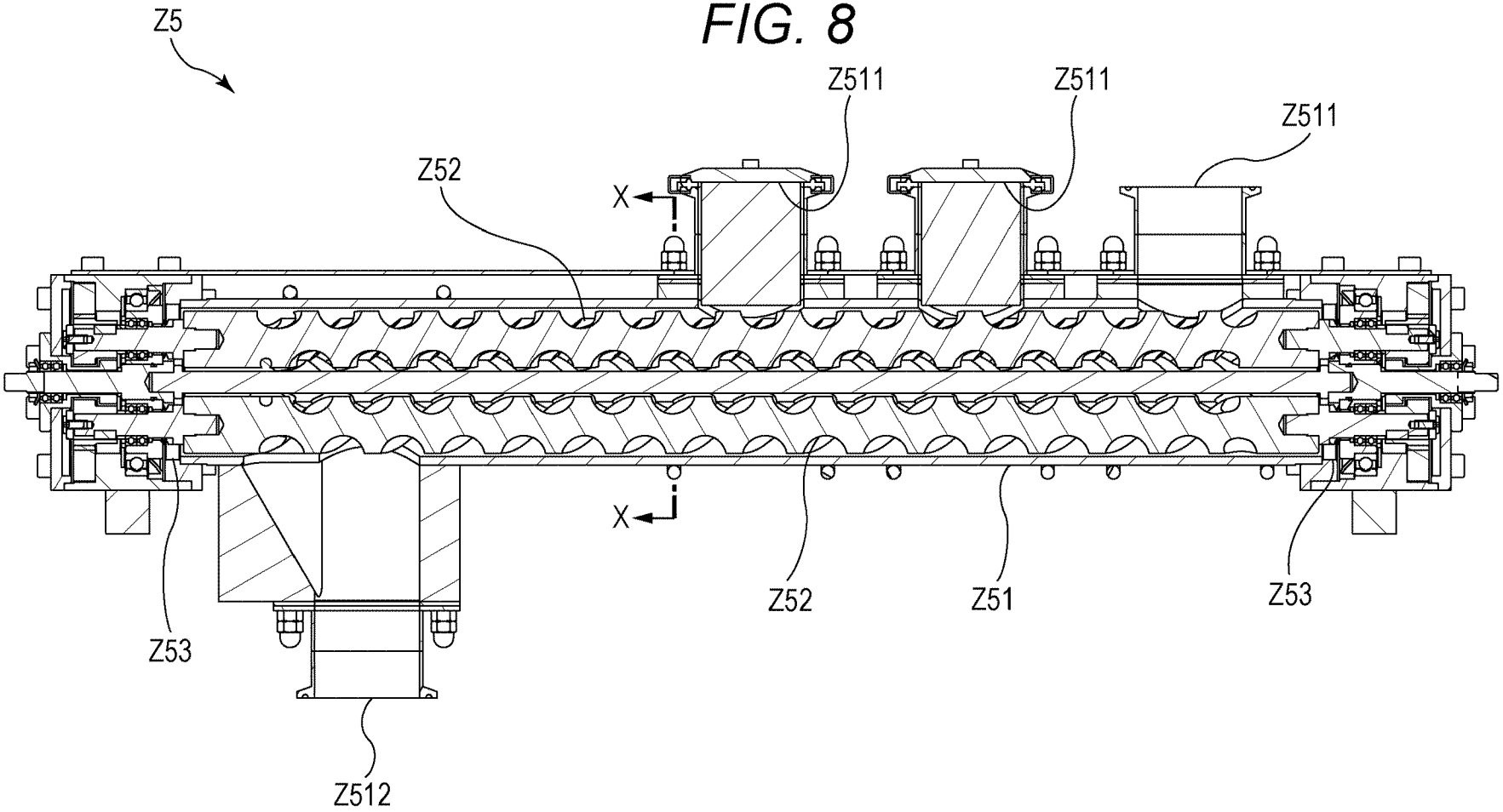
FIG. 8 is a side sectional view of a horizontal mixer according to an exemplary embodiment of the invention.
Figure 9:
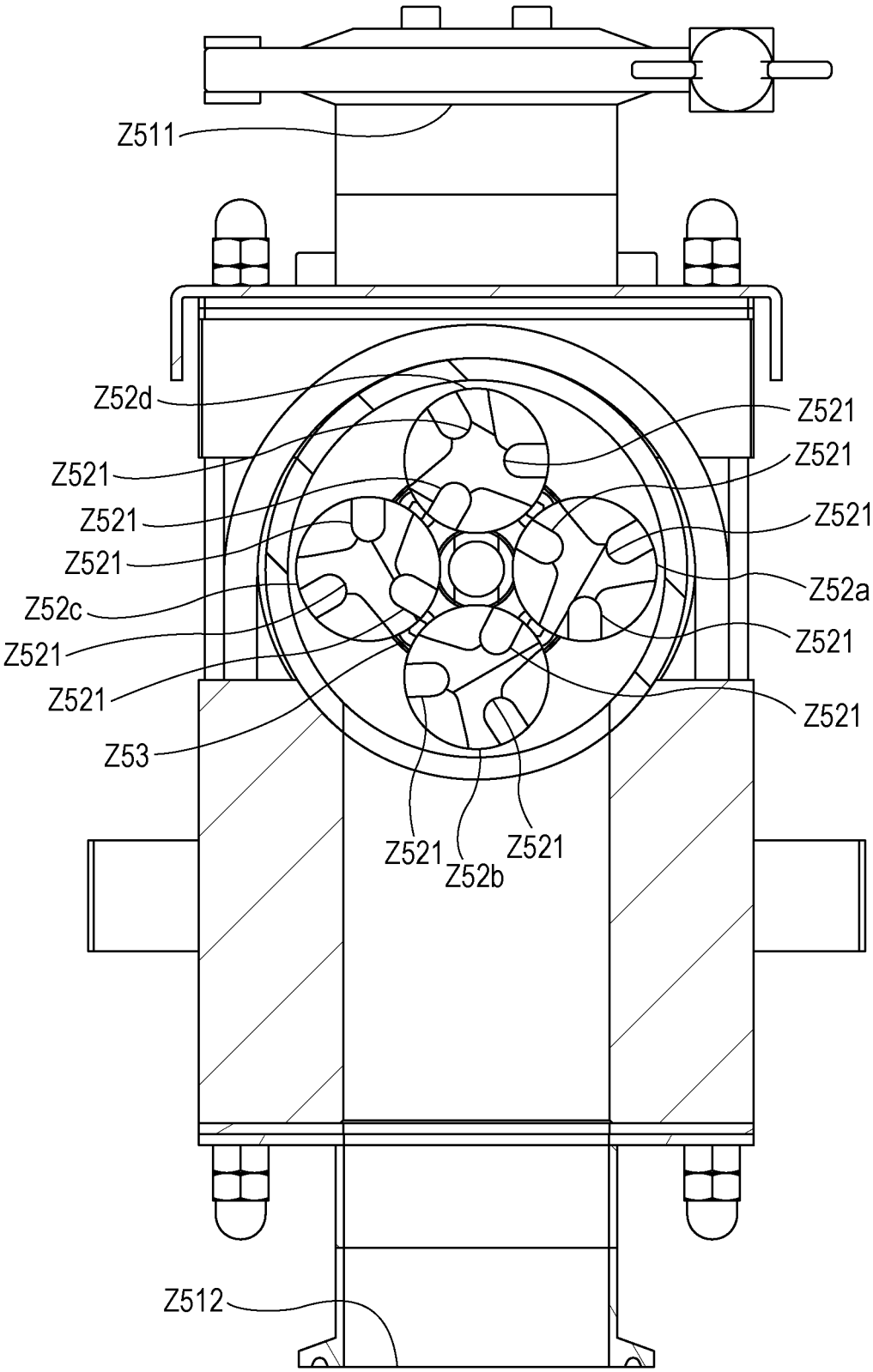
FIG. 9 is a sectional view taken along line X-X of the horizontal mixer.

A horizontal mixer Z5 shown in FIG. 8 includes a cylindrical case Z51, a plurality of agitating bars (e.g., second mixing members) Z52 disposed in the case Z51 and configured to spin, a connecting member Z53 connected with the plurality of agitating bars Z52, and a motor (not shown) configured to rotate the connecting member Z53 (e.g., revolve each of the agitating bars Z52). The driven motor rotates (e.g., spins) the connecting member Z53 and integrally rotates (e.g., revolves) the plurality of agitating bars Z52.

In this exemplary embodiment, the plurality of agitating bars Z52 is entirely rotated in a single direction by the driven motor, and the meshing of gears spins the agitating bars Z52, respectively. In other words, each of the agitating bars Z52 spins and revolves simultaneously. In this exemplary embodiment, there are included four agitating bars Z52 (e.g., Z52*a*, Z52*b*, Z52*c*, and Z52*d*) as shown in FIG. 9. Note that the motor is similar to the motor shown in FIG. 4.

The case Z51 has a top including a plurality of feed ports Z511 from which powdery materials are fed into the case Z51 and a discharge port Z512 through which mixed powdery materials are discharged from the case Z51. The case Z51 according to this exemplary embodiment does not rotate (e.g., spin), but the case Z51 may be configured to rotate. This achieves further improvement in mixing degree of the powdery materials.

The agitating bars Z52 each include a groove Z521. Furthermore, as shown in FIG. 9, in this exemplary embodiment, the first agitating bar Z52*a* and the third agitating bar Z52*c* spin clockwise whereas the second agitating bar Z52*b* and the fourth agitating bar Z52*d* spin counterclockwise in a sectional view from a downstream side of the flow of powdery materials. Then, the agitating bars Z52*a*, Z52*b*, Z52*c*, and Z52*d* entirely rotate (e.g., revolve) in a single direction (e.g., second mixing).

Such a configuration achieves improvement in mixing degree of the powdery materials. The direction of rotation (e.g., spin) of each of the agitating bars Z52*a*, Z52*b*, Z52*c*, and Z52*d* can be set freely, and the direction of entire rotation (e.g., the direction of rotation of the connecting member Z53) can also be set freely.

Third Exemplary Embodiment

Description will be made to an exemplary embodiment different from the first and second exemplary embodiments of the invention. The features similar to those of the first and second exemplary embodiments will not be described repeatedly.

A horizontal mixer (e.g., second mixer) shown in FIGS. 10 to 12 will be described by focusing on differences in configuration from the horizontal mixer Z4 according to the first exemplary embodiment and the horizontal mixer Z5 according to the second exemplary embodiment.

Figure 10:
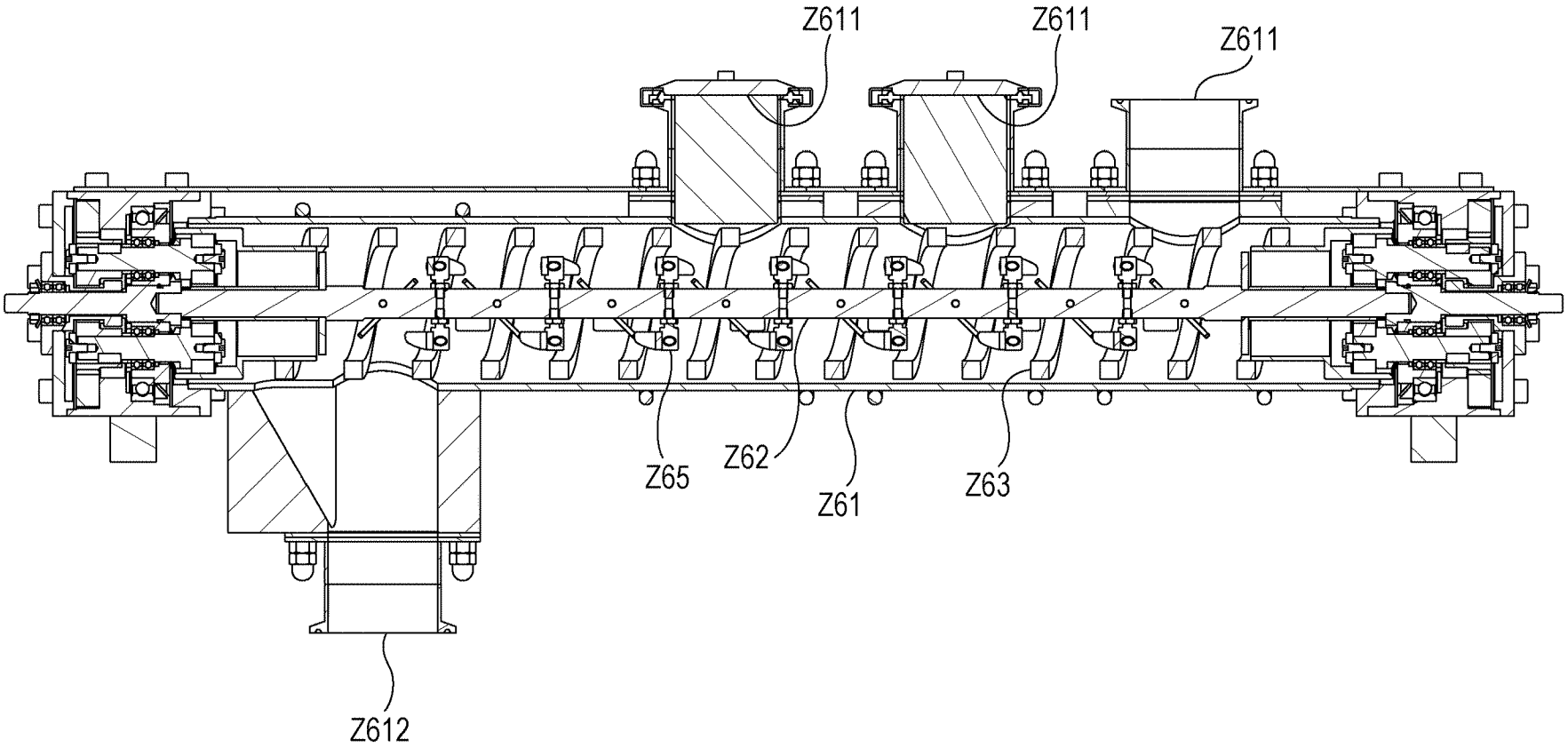
FIG. 10 is a side sectional view of a horizontal mixer according to an exemplary embodiment of the invention.

A horizontal mixer Z6 shown in FIG. 10 includes a cylindrical case Z61, an agitation shaft Z62 disposed substantially in the center in a sectional view of the case Z61 and configured to spin, a spiral member Z63 configured to move a powdery material in the axial direction, a motor (not shown) configured to rotate (e.g., spin) the agitation shaft Z62 and the spiral member Z63, and an agitating rotor Z65 attached to the agitation shaft Z62.

The agitation shaft Z62 and the agitating rotor Z65 are similar in configuration to the agitation shaft Z42 and the agitating rotor Z44 according to the first exemplary embodiment, respectively. The case Z61 according to this exemplary embodiment does not rotate (e.g., spin), but the case Z61 may be configured to rotate. Note that the motor is similar to the motor according to the first exemplary embodiment as shown in FIG. 4.

In the horizontal mixer Z6 according to this exemplary embodiment, powdery materials fed from feed ports Z611 are simultaneously mixed and moved to a discharge port Z612 by rotation of the agitating rotor Z65. Furthermore, rotation of the spiral member Z63 helps the powdery materials to move toward the discharge port Z612 (e.g., second mixing).

The case Z61 has a top including the plurality of feed ports Z611 from which powdery materials are fed into the case Z61 and the discharge port Z612 through which mixed powdery materials are discharged from the case Z61.

As shown in FIG. 11, the agitation shaft Z42 (e.g., Z62) includes the plurality of agitating rotors Z44 (e.g., Z65) in the axial direction. Spin of the agitation shaft Z42 (e.g., Z62) rotates the agitating rotors Z44 (e.g., Z65) to mix the powdery materials passing through the horizontal mixer Z6.

Figure 12:
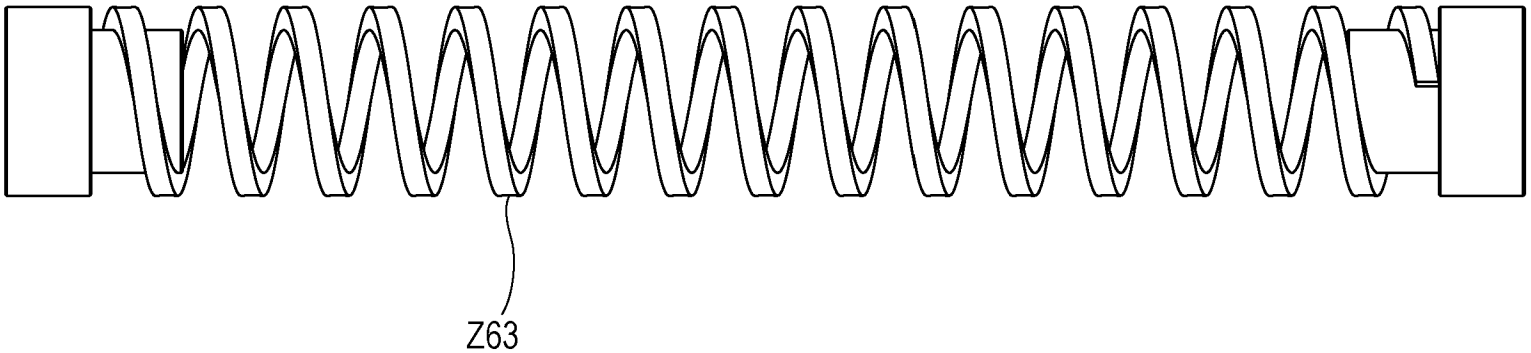
FIG. 12 is a side view of a spiral member of a horizontal mixer included in a powdery material mixing and feeding device according to an exemplary embodiment of the invention.

As shown in FIGS. 10 and 12, the case Z61 includes the spiral member Z63. Spin of the spiral member Z63 moves the powdery materials in the case Z61 in the axial direction. Such a configuration achieves improvement in mixing degree of the powdery materials.

A flow of processes of producing mixed powdery materials will be described in accordance with the exemplary embodiments. Firstly, the first measuring feeder Z1*a* simultaneously measures and feeds a principal agent, and the second measuring feeder Z1*b* simultaneously measures and feeds an excipient or the like (e.g., measuring and feeding). Next, the powdery materials of the principal agent and the excipient or the like are fed to the first vertical mixer Z3*a* functioning as the first mixer and are mixed therein (e.g., first mixing). In the first vertical mixer Z3*a*, the agitating rotor Z34 rotates about the agitation shaft Z33 functioning as a substantially vertical shaft, and mixes the powdery materials of the principal agent and the excipient or the like. Next, the powdery materials of the principal agent and the excipient or the like subjected to the first mixing are fed to the horizontal mixer Z4 (e.g., Z5, Z6) functioning as the second mixer and are mixed therein (e.g., second mixing). In the horizontal mixer Z4 (e.g., Z5, Z6), the agitating rotor Z44 (e.g., Z65) rotates about the agitation shaft Z42 (e.g., Z62) functioning as a substantially horizontal shaft, and mixes the powdery materials of the principal agent and the excipient or the like.

Such processes achieve improvement in mixing degree of the at least two types of powdery materials (e.g., the principal agent and the excipient or the like), and also there is less variation in the principal agent. As shown exemplarily in FIGS. 3 and 4, third mixing of feeding the powdery materials to the second vertical mixer Z3*b* and mixing therein may be conducted after the second mixing conducted by the horizontal mixer Z4 (e.g., Z5, Z6). This achieves further improvement in mixing degree of the at least two types of powdery materials.

Further, the first mixing preferably includes reserving part of the powdery materials to be mixed. In other words, the powdery materials pass through the plurality of bores Z321 in the powdery material passing member Z32 including the bores Z321. However, the amount of the powdery materials to be fed to the first vertical mixer Z3*a* or rotational speed of the auxiliary rotor Z35 is adjusted by the amount of the powdery materials passing through the bores Z321, and thus the powdery materials are reserved in the reservoir. Then, the powdery materials are mixed by agitation with the auxiliary rotor Z35, and simultaneously pass through the bores Z321.

Furthermore, as shown exemplarily in FIGS. 3 and 4, the lubricant is fed from the third measuring feeder Z1*c* to the horizontal mixer Z4 in this exemplary embodiment (e.g., lubricant feeding). The lubricant is fed to the horizontal mixer Z4 in this exemplary embodiment. However, for example, the lubricant may be fed to the second vertical mixer Z3*b*. There is no limitation in terms of the destination to feed the lubricant. Furthermore, the lubricant may be fed by the μR feeder (manufactured by Nisshin Engineering Inc.). Furthermore, the lubricant may be fed by an atomizer (e.g., spray device).

Further, the powdery materials mixed as described above (e.g., the mixed powdery materials) are fed to the hopper 19 of the compression-molding machine. The mixed powdery materials fed to the hopper 19 are fed to the feeder X functioning as a filling device by the powdery material feeding device. The mixed powdery materials fed to the feeder X are subjected to filling the die bore 4 in the turret 3 (e.g., filling). The mixed powdery materials with which the die bore 4 is filled are compression molded by the upper punch 5 and the lower punch 6 (e.g., compression molding). The mixed powdery materials subjected to the compression molding are discharged to the molded product unloading portion by the guide member 17 as a molded product.

Furthermore, prior to the filling, a lubricant (e.g., external lubricant) may be sprayed to the lower end surface of the upper punch 5, the upper end surface of the lower punch 6, and the interior of the die bore 4 (e.g., lubricant feeding).

Further, the production method preferably includes measuring the mixing degree of the mixed powdery materials after the mixing of the powdery materials by the powdery material mixing and feeding device Z. The mixing degree of the mixed powdery materials can be measured in accordance with a near infrared spectroscopic analysis or the like. According to such a configuration, it is possible to check whether or not the powdery materials are mixed properly and continuously and this leads to quality maintenance of a molded product (e.g., a tablet).

The invention is not limited to the exemplary embodiments described above. Specific configurations of the respective portions can be modified without departing from the spirit of the invention.

For example, the powdery material may be fed by a device having a feeding function similar to that of the μR feeder (manufactured by Nisshin Engineering Inc.). Furthermore, the powdery materials in the mixer may be mixed while feed of powdery materials from the mixer (e.g., the first mixer or the second mixer) is stopped.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Further, Applicant's intent is to encompass the equivalents of all claim elements, and no amendment to any claim of the present application should be construed as a disclaimer of any interest in or right to an equivalent of any element or feature of the amended claim.

What is claimed is:

1. A powdery material mixing and feeding device configured to mix at least two types of powdery materials and to feed a compression-molding machine with the mixed powdery materials, the powdery material mixing and feeding device comprising:

a first mixer including a first mixing member configured to rotate about a substantially vertical shaft and to mix the powdery materials, and a reservoir configured to reserve at least a part of the powdery materials;

a second mixer including a second mixing member configured to rotate about a substantially horizontal shaft and to mix the powdery materials;

a first connecting pipe vertically extending between a bottom surface of the substantially vertical shaft and a top surface of the substantially horizontal shaft;

a third mixer including a third mixing member configured to rotate about another substantially vertical shaft and to mix the powdery materials; and a second connecting pipe vertically extending between a bottom surface of the substantially horizontal shaft and a top surface of said another substantially vertical shaft, wherein the first connecting pipe directly feeds the powdery materials from the bottom surface of the substantially vertical shaft into the top surface of the substantially horizontal shaft, and the second connecting pipe directly feeds the powdery materials from the bottom surface of the substantially horizontal shaft into the top surface of said another substantially vertical shaft.

2. The powdery material mixing and feeding device according to claim 1, further comprising:

a plurality of measuring feeders each configured to measure and feed a powdery material, wherein the measuring feeders each feed at least one of the first mixer and the second mixer with the measured powdery material.

3. The powdery material mixing and feeding device according to claim 1, wherein the reservoir includes a powdery material passing member including a plurality of bores.

4. The powdery material mixing and feeding device according to claim 2, wherein the reservoir includes a powdery material passing member including a plurality of bores.

5. The powdery material mixing and feeding device according to claim 1, further comprising:

a measuring feeder configured to measure and feed a lubricant, wherein the measuring feeder feeds the second mixer with the measured lubricant.

6. The powdery material mixing and feeding device according to claim 3, further comprising:

a measuring feeder configured to measure and feed a lubricant, wherein the measuring feeder feeds the second mixer with the measured lubricant.

7. A compression molding machine, comprising:

a table including a vertically penetrating die bore, a slidable lower punch including an upper end inserted to the die bore, and a slidable upper punch including a lower end inserted to the die bore; and the powdery material mixing and feeding device according to claim 1.

8. A compression molding machine, comprising:

a table including a vertically penetrating die bore, a slidable lower punch including an upper end inserted to the die bore, and a slidable upper punch including a lower end inserted to the die bore; and the powdery material mixing and feeding device according to claim 2.

9. A compression molding machine, comprising:

a table including a vertically penetrating die bore, a slidable lower punch including an upper end inserted to the die bore, and a slidable upper punch including a lower end inserted to the die bore; and the powdery material mixing and feeding device according to claim 3.

10. A compression molding machine, comprising:

a table including a vertically penetrating die bore, a slidable lower punch including an upper end inserted to the die bore, and a slidable upper punch including a lower end inserted to the die bore; and the powdery material mixing and feeding device according to claim 4.

11. A compression molding machine, comprising:

a table including a vertically penetrating die bore, a slidable lower punch including an upper end inserted to the die bore, and a slidable upper punch including a lower end inserted to the die bore; and the powdery material mixing and feeding device according to claim 5.

12. A compression molding machine, comprising:

a table including a vertically, penetrating die bore, a slidable lower punch including an upper end inserted to the die bore, and a slidable upper punch including a lower end inserted to the die bore; and the powdery material mixing and feeding device according to claim 6.

* * * * *